United States Patent [19]

Yoshida et al.

[11] 4,362,377

[45] Dec. 7, 1982

[54] FILM PROCESSOR WITH AGITATION MEANS

[75] Inventors: Atsushi Yoshida; Norimasa Nomura, both of Kyoto, Japan

[73] Assignee: Dainippon Screen Mfg. Co., Ltd., Kyoto, Japan

[21] Appl. No.: 306,949

[22] Filed: Sep. 30, 1981

[30] Foreign Application Priority Data

Oct. 17, 1980 [JP] Japan ..... 55-148904[U]

[51] Int. Cl.[3] ..... G03D 3/04; G03D 3/08

[52] U.S. Cl. ..... 354/320; 354/324; 354/328; 366/137

[58] Field of Search ..... 354/320, 321, 322, 324, 354/325, 326, 328, 298; 366/137, 151

[56] References Cited

U.S. PATENT DOCUMENTS 4,156,569 5/1979 Fasano ..... 354/328

4,312,585 1/1982 Otsu et al. ..... 354/321

*Primary Examiner*—L. T. Hix

*Assistant Examiner*—Alan Mathews

*Attorney, Agent, or Firm*—Brumbaugh, Graves, Donohue & Raymond

[57] ABSTRACT

The insertion of exposed film into a developing tank 1 is detected by a detector 12, by which a pump motor 8 is operated by a control circuit 20, to agitating continuously the developing solution filled in the tank, and simultaneously a pulse counter 16 stars counting pulses generated from a pulse generator 14. The continuous agitation of the developing solution is suspended when the film is discharged from the tank, which is measured by counting up to the predetermined number which corresponds to the time required for the film treatment in the tank. When the pulse counter 16 counts up to the predetermined number, the intermittent agitation of the developing solution is started by the control circuit 20, to keep the developing solution uniform.

5 Claims, 4 Drawing Figures

FILM PROCESSOR WITH AGITATION MEANS

BACKGROUND OF THE INVENTION

The present invention relates to a film processor, particularly to an apparatus to control the agitation of the developer adequately and minimize deterioration of the developer caused by oxidation.

The most popular type of film processor, continuous feed type, has generally been so composed that film inserted from one end of a processor is subjected to all the required processings such as developing, fixing, washing and drying, and processed film is discharged from the other end of the processor. In all the required processings, the developing is most important and requires careful operations. That is, four factors, i.e. developing time, temperature of developer, agitation of the developer and activity of the developer, have influence primarily upon the processing completion. Many of the processors are so composed that the factors are respectively controlled to a predetermined value which is set in advance.

As for the agitation of the developer among the above four factors, attention should be paid to following two aspects: the ratio of the agitating time to the whole developing time and the intensity of the agitation. Ordinarily a pump is provided outside a developing tank to circulate or agitate the developer, in which the rate of the pump rotation is kept at a predetermined level. Since the developer is agitated in such a manner as mentioned above, comparatively fresh developer is supplied even to highly exposed parts of film to enable prompt development and accordingly to ensure fine development. The more the agitation of the developer, the higher the effect of evenness, efficiency and prompt operation. On the other hand, however, the high degree of the agitation promotes oxidation and acclerates deterioration of the developer. Consequently, it is considered favorable to continuously agitate the developer while film is supplied in the developing tank and subject to the developing treatment, and to suspend the agitation when no film is supplied in it. In which it should be taken into consideration that the developer is deteriorated due to consumption of the developing solution, by-product of development or oxidation caused by the agitation. In order to compensate for the developer deterioration, it is required to replenish fresh developer and/or to control the composition of the developer evenly at all the parts.

Conventionally the developing tank has been made deeper to minimize the surface of the developer which is exposed with air, in which the developer agitation is not suspended even after developing. This arrangement, however, has not been effective enough. Or, in order to prevent the developer from deteriorating, a film processor which is so composed that both the agitation degree of the developer and the film conveyance through the developer can be varied in accordance with the film position has been made. This arrangement, however, makes a film processor itself large sized and is very expensive.

BRIEF SUMMARY OF THE INVENTION

Accordingly, the primary object of the present invention is to provide a film processor in which developer is maintained at a favourable condition in accordance with film condition.

It is another object of the present invention to provide a film processor in which the developer is prevented from deteriorating due to the agitation of the developer.

It is another object of the present invention to provide a film processor having a small size.

While the specification concludes with claims particularly pointing out and distinctly claiming the subject matter of the invention, it is believed the invention will be better understood from the following description taken in connection with the accompanying drawings in which:

FIG. 1 is a diagrammatic view in cross section of a developing tank incorporated to a film processor according to the present invention, FIG. 2 is a block diagram of a control circuit for agitating speed of developer, FIG. 3 is a timing chart of signals of the above control circuit, in which Ⓐ shows a detecting signal for film insertion, Ⓑ shows a pulse signal which is generated every film feed units and Ⓒ shows a change-over signal for changing continuous rotation of a pump motor into intermittent, and FIG. 4 is a circuit diagram of a signal generating circuit for intermittent agitation shown in FIG. 2.

DETAILED DESCRIPTION OF THE INVENTION

Figure 1:
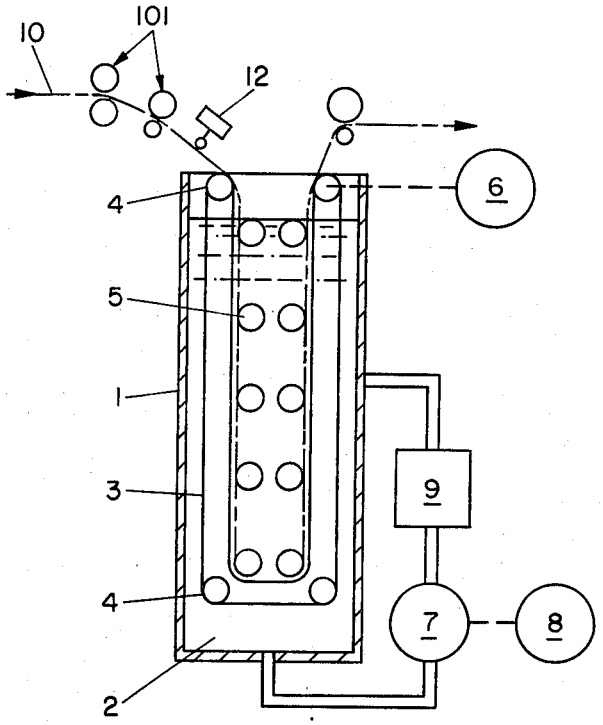

Referring to FIG. 1, film to be processed 10 is conveyed into a developing tank 1, in which developer 2 is filled therein, through guide rollers 101 and is conveyed by pressing rollers 5 and a feed belt 3 which is stretched over belt pulleys 4 and held between them, in which the pulleys and rollers are respectively rotated simultaneously with each other by a motor 6 which is connected to them. The developer 2 is agitated or circulated by a pump 7 to which a pump motor 8 is connected; that is, the developer 2 is sucked in from the bottom of the tank 1 and is circularly supplied from the upper side of it through a filter 9. To the pump 7 a replenisher tank is connected, which is not directly related to the present invention, accordingly illustration of it is omitted. In the developing tank 1 the film is conveyed in such a manner as described above, in which film conveying course is shown as long and a dash line in FIG. 1, and then the film is conveyed into a following processing stage. A film detector 12 such as a micro-switch is provided near to the guide rollers 101, by which timing of film insertion into the tank 1 is detected.

Figure 2:
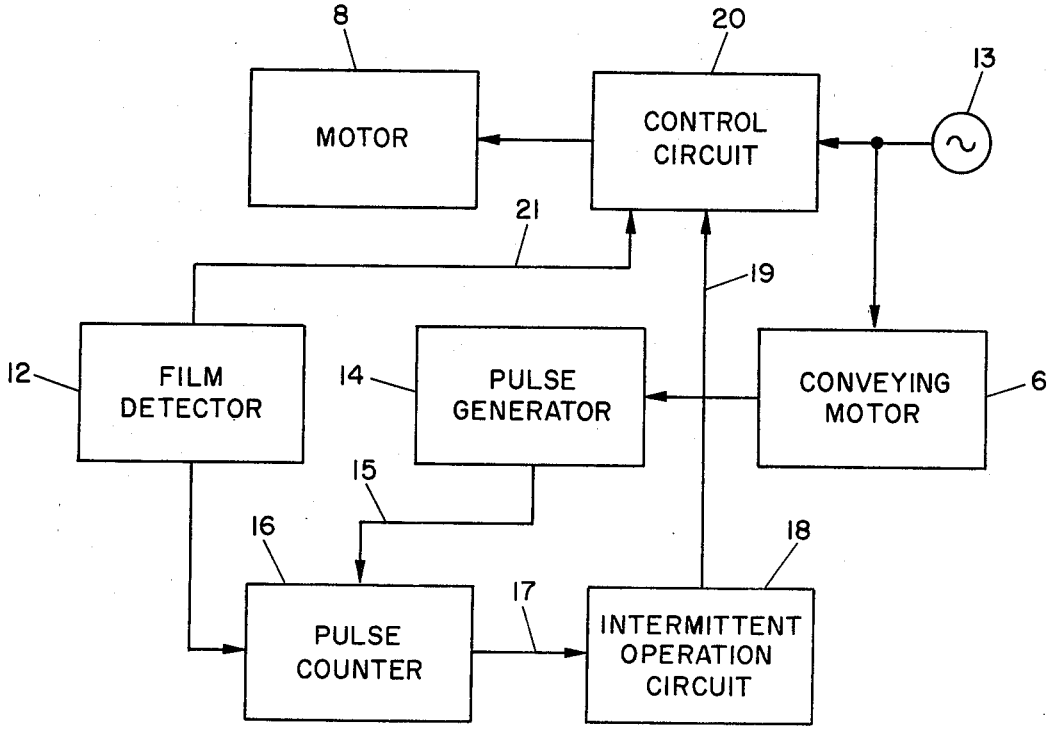

Referring to FIG. 2, a pulse generator 14 generates pulses regularly every film feed units, simultaneously with the rotation of the rollers 5 and the pulleys 4. A pulse counter 16 generates a signal 17 when the pulses 15 generated from the pulse generator 14 is counted up to the predetermined number. Receiving the signal 17 of the pulse counter 16, a signal generating circuit for intermittent agitation 18 generates an intermittent agitating signal 19, which is supplied into a control circuit for pump motor 20.

The operation of the above composition is made as follows.

Figure 3:
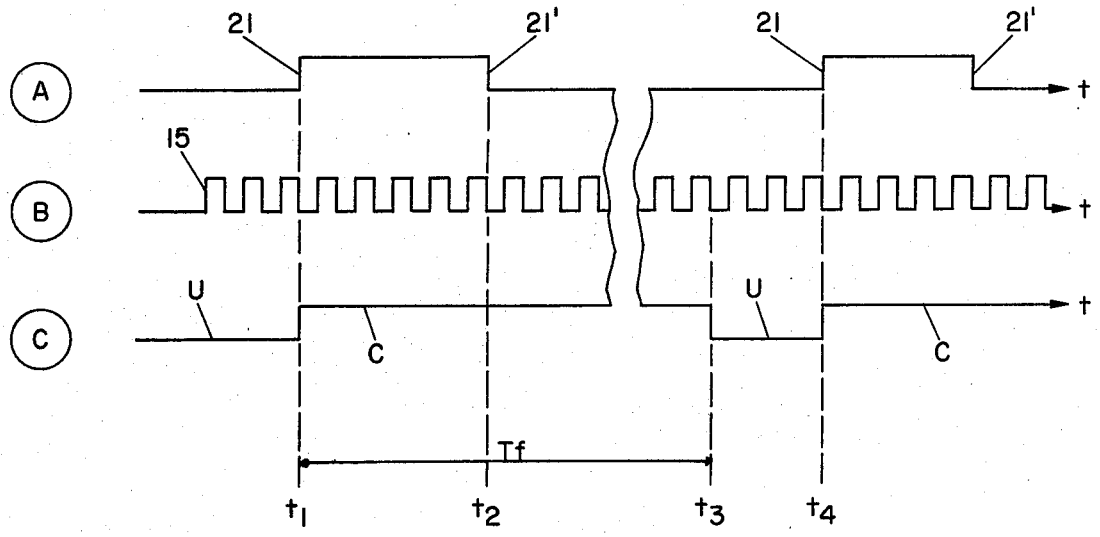

Referring to FIG. 3, A shows a film detecting signal generated by the detector 12, in which a signal 21 is generated when the leading edge of film 10 is passed at the detector 12 and a signal 21' is generated when the trailing edge of the film 10 is passed at the detector 12. Proposed that the leading edge of film 10 is detected by the detector 12 at a certain time $t_1$, a signal 21 is generated and is supplied to the control circuit 20, by which the pump motor 8 is operated to be in the continuous controlling condition C. Then, when the trailing edge of the film is detected by the detector 12 as the film advances, a signal 21' is generated and is supplied to the pulse counter 16, by which the pulse counter 16 is started to count the pulses generated from the pulse generator 14 up to predetermined number. B shows the condition of the pulse signal, where the count of the pulses is started from a predetermined time $t_2$ which is corresponding to the time when the signal 21' is generated by the detector 12. The count of the pulses is continued up to the predetermined number which corresponds to the time $t_3$, when the film is conveyed out of the tank 1. Accordingly, the agitation of the developer 2 is made for a period Tf which corresponds to the period from $t_1$ to $t_3$. At the time $t_3$ when the counter 16 counts up to the predetermined pulses, the signal 17 is generated by the pulse counter 16, and then the control circuit is changed to intermittent operation which is kept till an input of the signal 21 (which corresponds to time $t_4$). In the continuous controlling condition C, the rotation of the pump motor 8 is kept by the control circuit 20 at a predetermined level which is favourable to the prompt developing operation owing to sufficient agitation of the developer. On the other hand, in the intermittent controlling condition U, the pump motor 8 is operated intermittently, whereby the developer is agitated in minimum required for even composition of the developer so that the developer may not be contact with air as possible. And, when another film to be developed is conveyed into the tank 1, which is detected at the time $t_4$ by the detector 12, the operation to the film is made in a same manner as mentioned above.

When another film is conveyed into the tank 1 during the advanced film is in it, i.e. when another signal 21 is generated by the detector 12 while the pulse counter 16 is already started to count the pulses after generation of the signal 21', the counting of the pulses is cancelled and is started to count pulses again.

Figure 4:
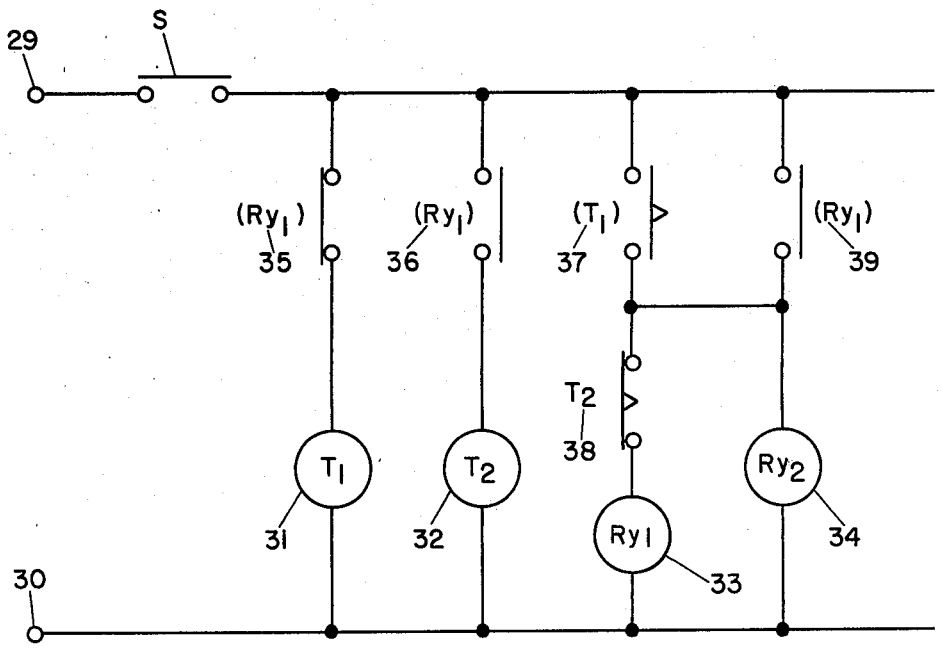

Referring to FIG. 4, which is a circuit diagram of the intermittent-operation-signal circuit 18, terminals 29, 30 are connected to a power source 13 shown in FIG. 2. A contact S is closed by the output of the signal 17, whereby the control circuit 20 is brought into the intermittent controlling condition U as shown in FIG. 3, and a coil 31 for a timer $T_1$ is actuated through a contact 35 of a relay $RY_1$. Then, after a predetermined period which is preset in the timer $T_1$, throughout which the pump motor 8 is suspended, a contact 37 is closed to actuate a coil 33 of the relay $RY_1$, whereby the contact 35 is opened and the contact 37 is also opened by release of the actuation of the coil 31. On the other hand, a contact 39 is closed by the actuation of the coil 33, whereby the relay $RY_1$ is operated to actuate a coil 34 of a relay $RY_2$. Since a contact of the relay $RY_2$ is provided at the control circuit 20 (not shown), said contact is closed by the actuation of the relay $RY_2$, whereby the pump motor 8 is operated. Moreover, a contact 36 is closed simultaneously with a series of the above operations of the relay $RY_1$, by which a coil 32 of a timer $T_2$ is actuated. Then, after a predetermined period which is preset in the timer $T_2$, throughout which the pump motor 8 is operated, a contact 38 of the timer $T_2$ is opened, whereby the coil 33 of the relay $RY_1$ is released from the actuation, accordingly the contact 39 is opened. As the coil 34 is released from the actuation by the contact 39, the contact provided at the control circuit 20 is opened to suspend the motor 8. Simultaneously with the actuation release of the coil 33, the contact 35 of the relay $RY_1$ is closed, and the coil 31 of the timer $T_1$ is actuated again. Then the intermittent agitating operation of the developer is repeated in the same manner as mentioned above. That is, at the input of the signal 17, a change from the continuous controlling condition C of the pump motor 8 to the intermittent controlling condition U takes place, and in the intermittent controlling condition U the pump motor 8 is operated to be suspended for a predetermined period preset in the timer $T_1$ and to be driven for a predetermined period preset in the timer $T_2$, which is repeated till the input of a detecting signal 21.

It is to be clearly understood that the present invention is not limited to the embodiment mentioned above and can also realized by other means for agitating the solution such as a stirrer or circulator.

Being so composed as mentioned above, the present invention can provide a convenient apparatus in which the film conveyance is kept at a constant speed under no processing condition of film so as to minimize deterioration of the developer by air oxidation through intermittent control of the circulation and agitating pump rotation without retarding other processes, the composition of the developer is kept evenly realizing adequate composition control of the other systems, and under the developing condition of film, even processing is performed efficiently through adequate speed control of the solution agitation. Since the apparatus according to the present invention can be composed of simple circuits and mechanisms, the cost may be lowered yet the expense for developing solution and electric power can be saved and the agitation mechanism such as the pump can be made mere durable.

What is claimed is:

1. A film processor having a film conveying device which conveys exposed film to be processed; a developing tank in which developing solution is supplied, said exposed film being conveyed through the tank; and an agitating device for agitating the developing solution, comprising a film detector for detecting the insertion of film into the developing tank, the detector generating a detecting signal; control means for controlling the said agitating device, the control means operating continuously the agitating device when the detecting signal is received and operating it intermittently when the film is conveyed out of the tank; and switchover means for switching over the said agitating device from the continuous agitation to the intermittent or inversely so that the developing solution is agitated continuously during film is in the tank and intermittently during film is not in it.

2. A film processor according to claim 1, wherein the switchover means is comprised of a pulse generator and a pulse counter, the pulse generator generating a pulse simultaneously with a motor rotation of the film conveying device, the pulse counter counting the pulse up to predetermined number, then operating the control means.

3. A film processor according to claim 1, wherein the control means is comprised of an intermittent operation circuit which operates the agitating device intermittently; and a control circuit which is connected to the intermittent operation circuit and the detector, which is switched over selectively in accordance with the film position on the film conveying device.

4. A film processor according to claim 3, wherein the intermittent operation circuit is comprised of two timers which are respectively variable to set predetermined period, one of the timers being set for operating the motor connected to the agitating device and the other for suspending it.

5. A film processor according to claims 1, 2, 3 or 4, wherein the agitating device agitates the developing solution by circulating the developing solution.

* * * * *